US012050086B1

(12) United States Patent
Boatswain

(10) Patent No.: US 12,050,086 B1
(45) Date of Patent: Jul. 30, 2024

(54) PROTECTIVE JACKET ARMOR

(71) Applicant: Abram Boatswain, Powder Springs, GA (US)

(72) Inventor: Abram Boatswain, Powder Springs, GA (US)

( * ) Notice: Subject to any disclaimer, the term of this patent is extended or adjusted under 35 U.S.C. 154(b) by 110 days.

(21) Appl. No.: 17/831,528

(22) Filed: Jun. 3, 2022

(51) Int. Cl.
*F41H 1/00* (2006.01)
*A41D 27/20* (2006.01)
*F41H 1/02* (2006.01)
*A41D 13/00* (2006.01)

(52) U.S. Cl.
CPC ..... *F41H 1/02* (2013.01); *A41D 27/20* (2013.01)

(58) Field of Classification Search
CPC ..... F41H 1/02; A41D 27/20
See application file for complete search history.

(56) References Cited

U.S. PATENT DOCUMENTS 4,466,135 A * 8/1984 Coppage, Jr. ..... F41H 1/02 2/2.5
5,008,959 A * 4/1991 Coppage, Jr. ..... F41H 1/02 2/2.5
5,039,567 A * 8/1991 Landi ..... B29C 66/1122 428/116
5,060,314 A * 10/1991 Lewis ..... A62B 17/003 2/2.5
5,621,914 A * 4/1997 Ramone ..... A41D 13/0518 2/92
6,062,929 A * 5/2000 Hallstrom ..... F41H 1/02 441/106
6,681,399 B1 * 1/2004 Kerr ..... A41D 13/0125 2/2.5
7,571,493 B1 * 8/2009 Purvis ..... F41H 1/02 2/2.5
7,636,948 B1 * 12/2009 Crye ..... A41D 31/12 2/2.5
10,231,533 B2 * 3/2019 Vaughan ..... A45F 3/06
11,807,303 B2 * 11/2023 Gombert ..... B62D 25/08
2004/0154076 A1 * 8/2004 Yoo ..... A41D 27/04 2/102
2005/0015855 A1 * 1/2005 Skiba ..... A42B 3/063 2/412
2005/0181024 A1 * 8/2005 Sabesan ..... D06M 11/05 424/443
2006/0080762 A1 * 4/2006 Kobren ..... A41D 13/0518 2/463
2006/0129067 A1 * 6/2006 Grajales ..... A61B 5/6804 600/586

(Continued)

*Primary Examiner* — Robert H Muromoto, Jr.
(74) *Attorney, Agent, or Firm* — Sanchelima & Associates, P.A.; Christian Sanchelima; Jesus Sanchelima

(57) ABSTRACT

A protecting jacket armor including a jacket assembly, a shirt assembly and additional protection assembly. The shirt assembly is removable attached to the jacket assembly. The jacket assembly and the shirt assembly include a para-aramid synthetic fiber to protect from some ammunition and memory foam. The para-aramid synthetic fiber covers the memory foam. The Jacket includes compartments built in the jacket. The additional protection assembly includes bullet proof plates and removable padding. The bullet proof plates are inserted onto the compartments to increase protection of the protecting jacket armor. The removable padding is removable attached to the jacket.

5 Claims, 5 Drawing Sheets

(56) References Cited

U.S. PATENT DOCUMENTS

Figure 1:
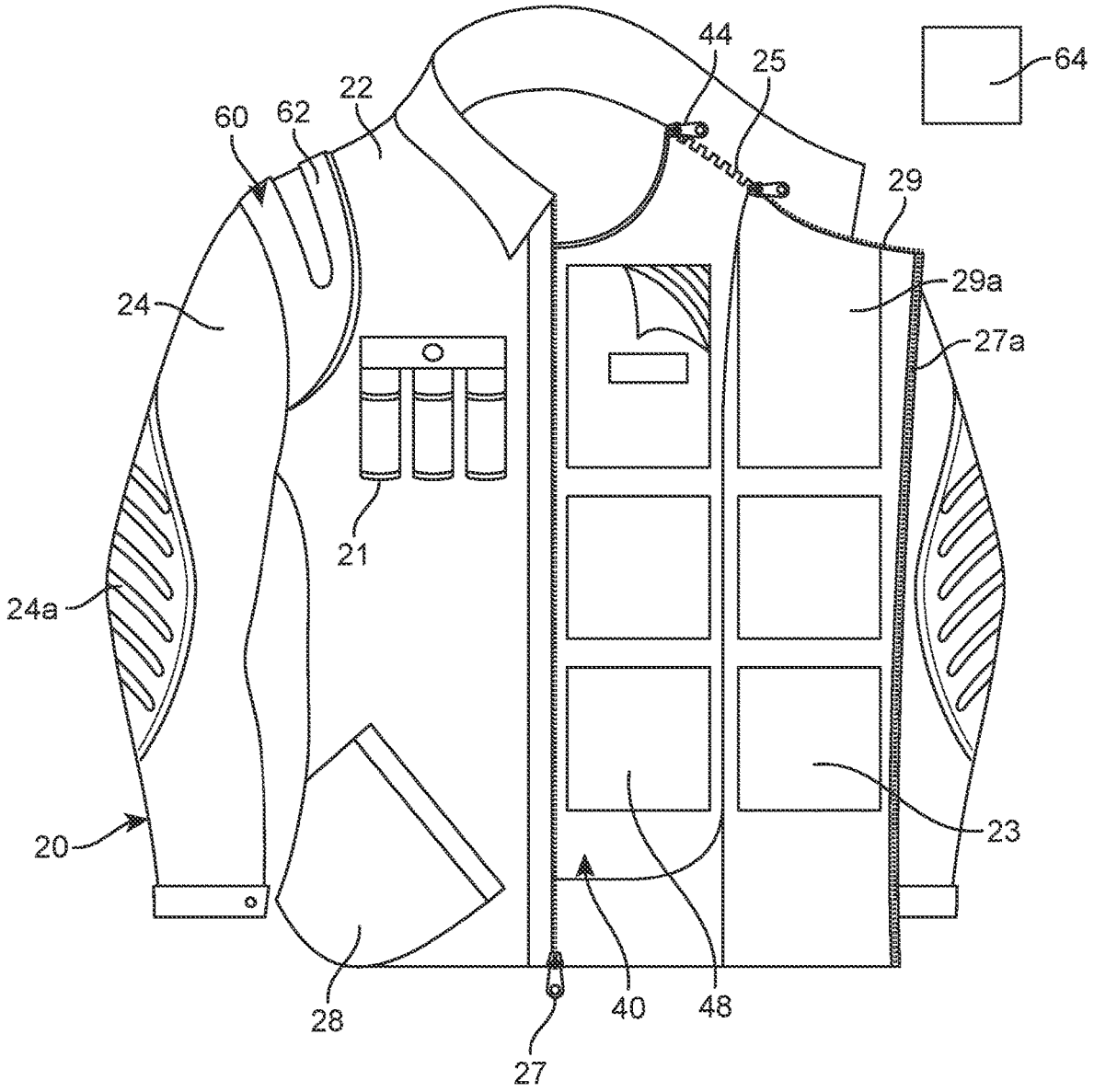

| | | | | |
|---|---|---|---|---|
| 2006/0253950 | A1* | 11/2006 | Kerr | A41D 13/0125 2/2.5 |
| 2007/0016996 | A1* | 1/2007 | Seitzinger | F41H 1/02 2/2.5 |
| 2008/0235855 | A1* | 10/2008 | Kobren | A41D 13/0518 2/463 |
| 2009/0282595 | A1* | 11/2009 | Branson | F41H 1/02 2/2.5 |
| 2011/0231976 | A1* | 9/2011 | Herbener | F41H 1/02 2/2.5 |
| 2011/0231985 | A1* | 9/2011 | Bishop | A41D 13/0153 2/456 |
| 2011/0277202 | A1* | 11/2011 | McQueer | F41H 1/02 2/2.5 |
| 2012/0174748 | A1* | 7/2012 | Landi | F41H 5/0478 89/922 |
| 2016/0231088 | A1* | 8/2016 | Blackmore | F41H 5/0492 |
| 2021/0145450 | A1* | 5/2021 | Gruentzig | A61B 5/6803 |

* cited by examiner

PROTECTIVE JACKET ARMOR

II. BACKGROUND OF THE INVENTION

1. Field of the Invention

The present invention relates to a protective Jacket armor and, more particularly, to a protective Jacket armor that protects a user from some ammunition using a double protective Jacket armor.

2. Description of the Related Art

Several designs for a protective armor have been designed in the past. None of them, however, include memory foam to fit better to the body of a user.

Applicant believes that a related reference corresponds to U.S. Pat. No. 7,571,493 B1 issued for an armored garment for protection. Applicant believes that another related reference corresponds to U.S. Pat. No. 7,636,948 issued for a combat shirt and armor system None of these references, however, teach of a Jacket made of multiple materials including memory foam and a para-aramid synthetic fiber which allow a user to be protected from some ammunition as well as stabbings.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a protective Jacket armor that includes a Kevlar layer to protect a user from some ammunition.

It is another object of this invention to provide a protective Jacket armor that includes a removable shirt assembly with the shape of a shirt to increase protection of the jacket.

It is still another object of the present invention to provide a protective Jacket armor that includes pockets to accommodate bullet proof plates.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 shows a front view of present invention 10 including a jacket assembly 20, a shirt assembly 40 and an additional protection assembly 60. The additional protection assembly includes removable padding 62 and bullet proof plates 64.

Figure 2:
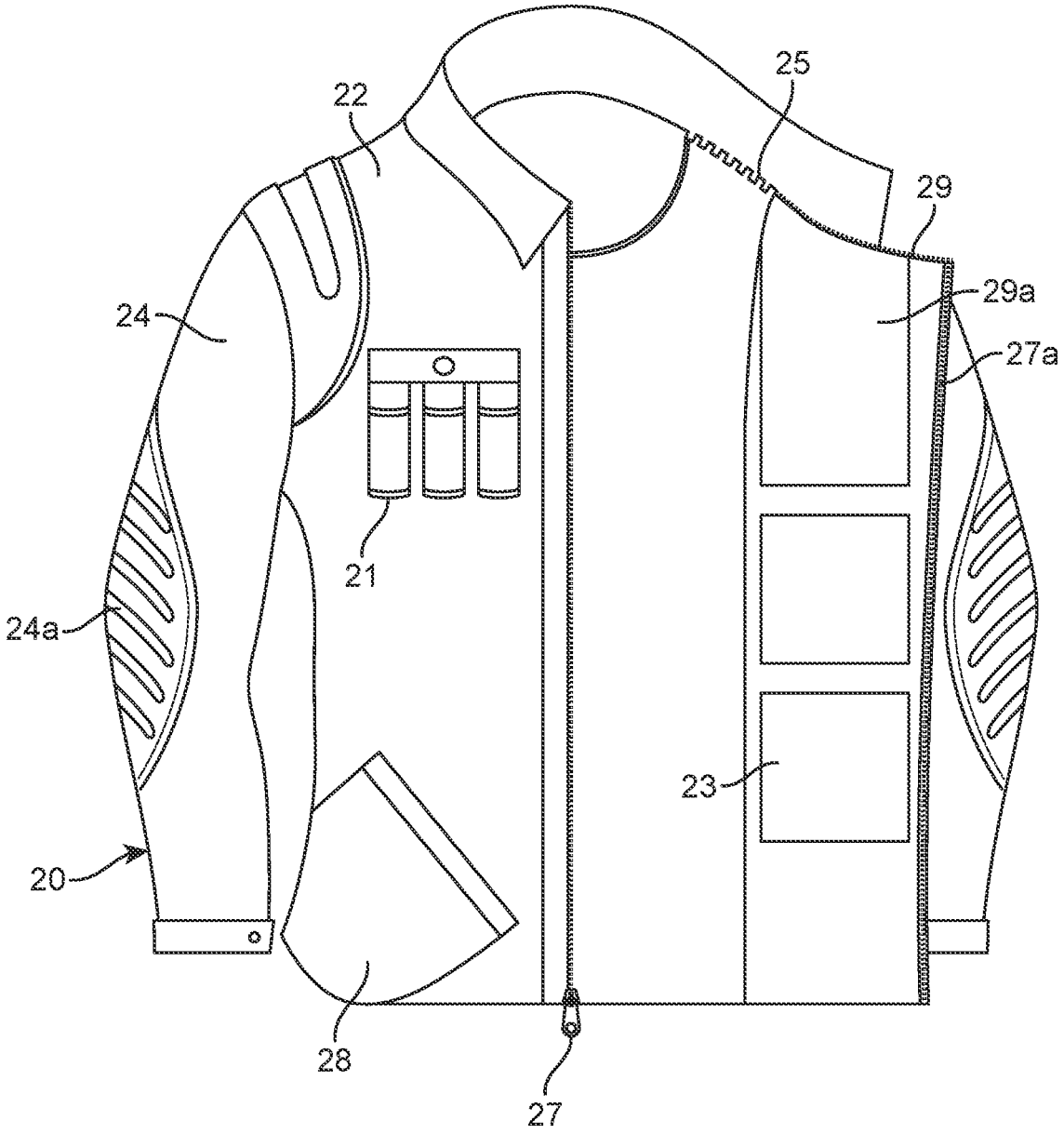

FIG. 2 shows an enlarged front view of jacket assembly 40.

Figure 3:
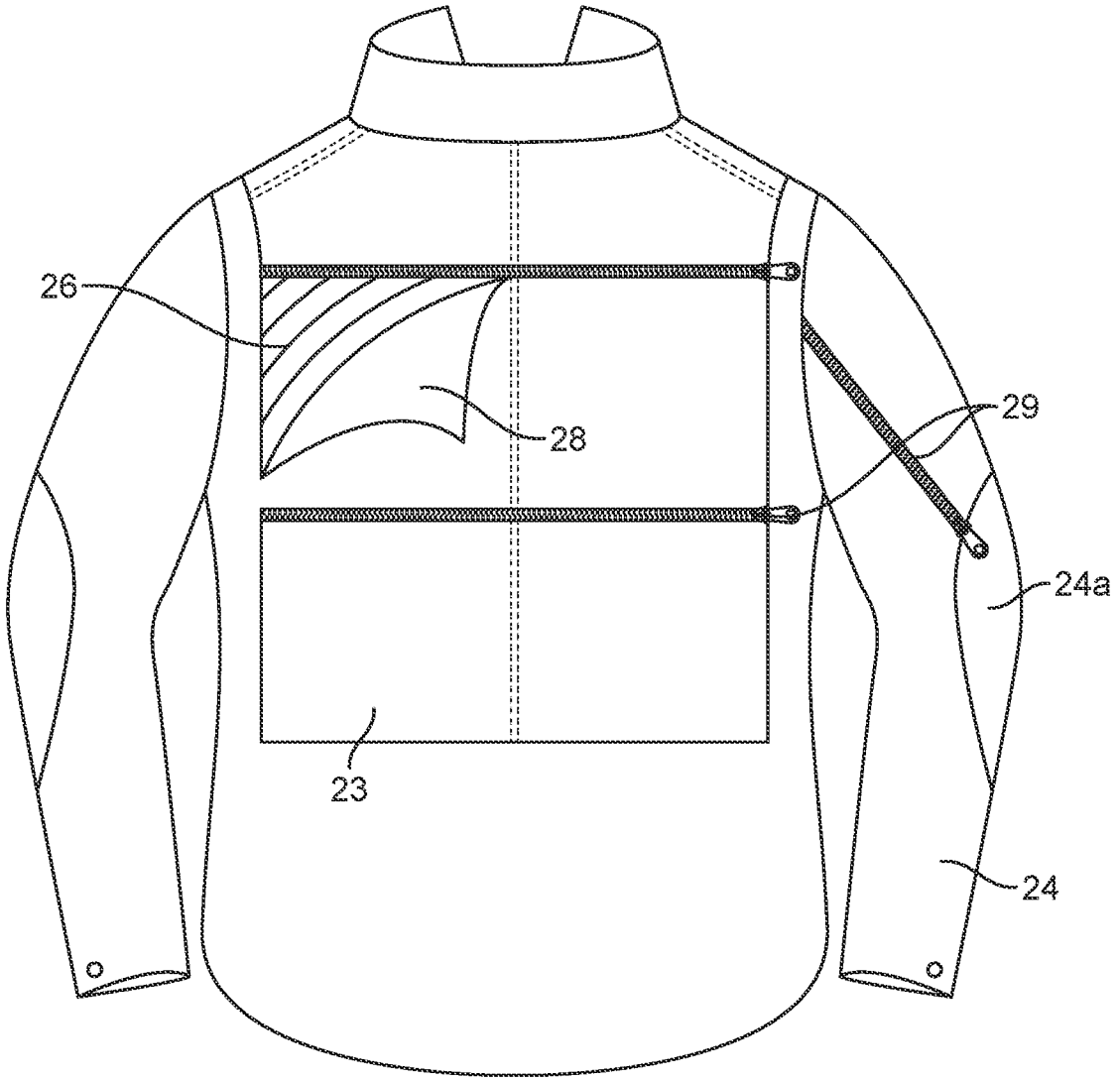

FIG. 3 illustrates a rear enlarged view of the jacket assembly 20. Bullet proof plates 64 may be inserted through first zippers 24.

Figure 3A:
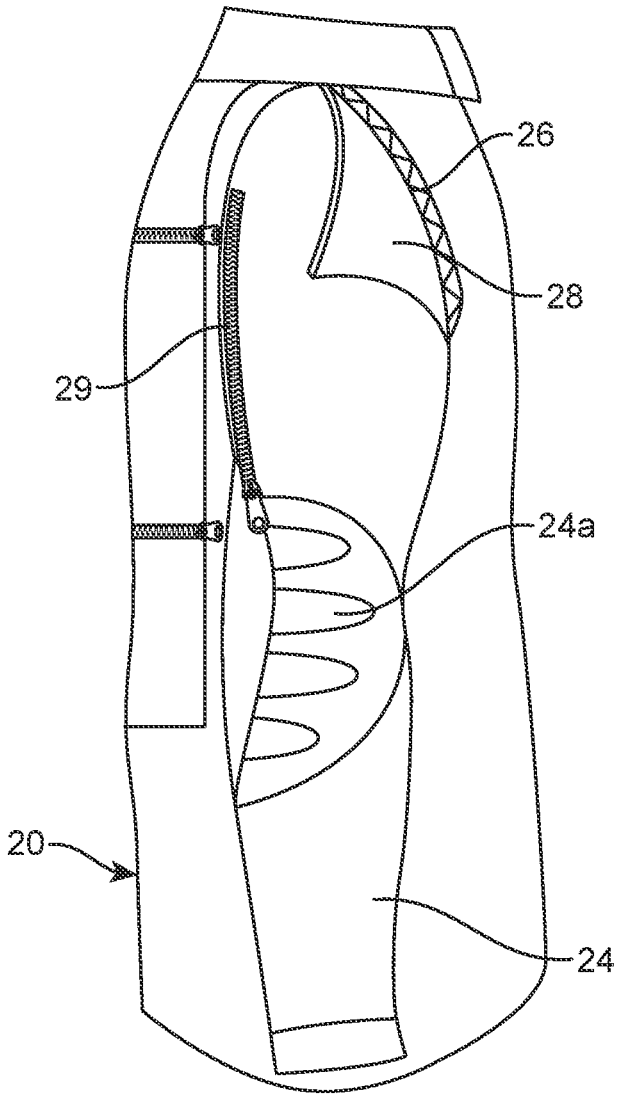

FIG. 3A illustrates a right view of the jacket assembly 20.

Figure 4:
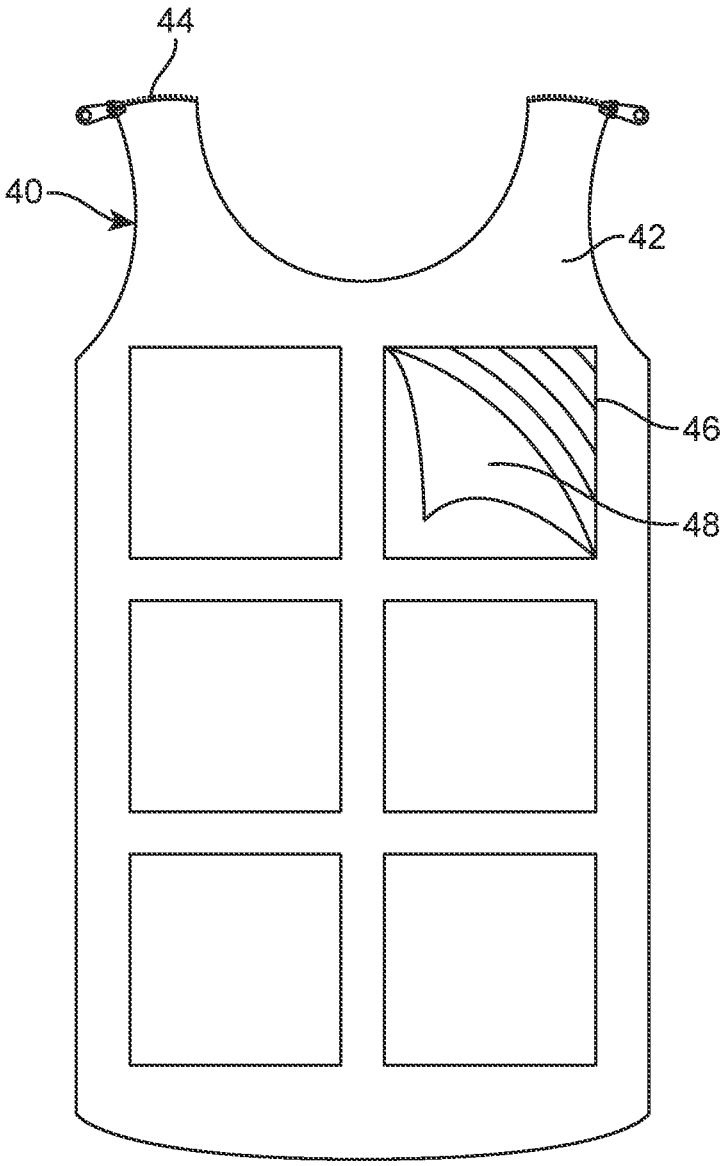

FIG. 4 is a representation of the shirt assembly 40. The shirt assembly includes a shirt 42, second teeth 44, foam 46 and a para-aramid synthetic fiber.

V. DETAILED DESCRIPTION OF THE EMBODIMENTS OF THE INVENTION

Referring now to the drawings, where the present invention is generally referred to with numeral 10, it can be observed that it basically includes a jacket assembly 20, a shirt assembly 40 and an additional protection assembly. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The jacket assembly 20 may include a jacket 22, containers 21, compartments 23, sleeves 24, first teeth 25, elbow protection 24*a*, second teeth 27*a*, third teeth 27, first zippers 29, a first layer 28, a second layer 26, and pockets 28. The jacket 22 is an outer garment extending either to the waist or the hips, typically having sleeves and a fastening down the front. The first layer 28 may be made of para-aramid synthetic fiber. Thus, the jacket 22 may be built in para-aramid synthetic fiber. The second layer 26 may be made of foam. In a preferred embodiment the foam is a memory foam. The first layer 28 may cover the second layer 26. In a preferred embodiment the para-aramid synthetic fiber is bulletproof.

The jacket 22 may have a right portion and a left portion. The first teeth 25, the second teeth 27*a* and the third teeth 27 are teeth of a zipper. The second teeth 27*a* may be vertically attached to the right portion of the jacket 22. The third teeth 27 may be vertically attached to the left portion of the jacket 22. The third teeth 27 may have a slider. The second teeth 27*a* and the third teeth 27 may match through a slider to close and open the jacket 22. In a preferred embodiment the second teeth 27*a* and the third teeth 27 are made of metal. It also may be suitable for the first teeth 25, the second teeth 27*a* and the third teeth 27 to be made of plastic, or any other suitable material. The first teeth 25 may connect the shirt assembly 40 to the jacket assembly 20.

The containers 21 may be located on a left upper front portion of the jacket 22. It also may be suitable for the containers 21 to have any other configuration in the jacket 22. The containers 21 may be used to store ammunition. It also may be suitable to use the container 21 to store coins or any other suitable object. In a preferred embodiment the containers 21 may have a cylindrical shape. The containers 21 may be hollow. The containers 21 may have an opening to introduce ammunition. It also may be suitable for the containers 21 to have a lid. The compartments 23 may be located on an inside portion of the jacket 22. The compartments 23 may be located on a rear portion of the jacket 22 as shown in FIG. 3. In a preferred embodiment, compartments 23 are compartments built in the jacket. The compartments 23 may have an opening. The compartment 23 may be used to store objects or to add additional elements of the additional protection assembly 60. The elbow protections 24*a* may be attached to the sleeves of the jacket 22. In a preferred embodiment the elbow protections 24*a* are made of metal. It also may be suitable for the elbow protections 24*a* to be made of rubber, leather, or any other resistant material.

Referring now to FIG. 3 one zipper of the first zippers 29 may be located on one of the sleeves 24 to store objects. Additional zippers of the first zippers 29 may be used to open and close the compartments 23. The jacket 22 may have pockets 28. In a preferred embodiment the pockets 28 are built in the jacket 22. It may be suitable for the pockets 28 to have buttons, zippers or any feature that allows the pockets 28 to close. In a preferred embodiment one of the pockets 22 is located on a lower bottom portion of the front of the jacket 22.

The shirt assembly 40 may include a shirt 42, fourth teeth 44, a first layer 48 and a second layer 46. In a preferred embodiment the shirt 42 is made of cloth. It may be suitable for the shirt 42 to be made of para-aramid synthetic fiber. In a preferred embodiment the shirt 42 may have portions built-in with a second layer 46 covered with a first layer 48. In a preferred embodiment the first layer 48 may be made of para-aramid synthetic fiber. In a preferred embodiment the second layer may be memory foam. The shirt assembly 40 may be removable attached to the jacket assembly 20 as shown in FIG. 1 through the fourth teeth 44 and the first teeth 25. The fourth teeth 44 may be teeth of a zipper. The fourth teeth 44 may include a slider of a zipper. In a preferred embodiment the fourth teeth 44 are made of metal. It also may be suitable for the fourth teeth 44 to be made of plastic or any other suitable material. In a preferred embodiment the fourth teeth 44 are located on an uppermost end of the shirt 42. In a preferred embodiment the fourth teeth 44 may match with the first teeth 25 through a slider. In a preferred embodiment a user may worn the jacket assembly 20, the shirt assembly 40 or the combination of both. It also may be suitable to add additional features of the additional protection assembly 60 to the jacket assembly 20.

The additional protection assembly 60 may include protective padding 62 and bulletproof plates 64. The bulletproof plates 64 may be made of ceramic, fiberglass, steel, wood, ceramic, or any other bulletproof material known in the prior art. In a preferred embodiment the bulletproof plates 64 may have a rectangular shape. It also may be suitable for the bulletproof plates 64 to have a circular shape, a triangular shape or any other shape that fits in the compartments 23. The bulletproof plates 64 may be fitted into the compartments 23 to provide additional protection to the jacket assembly 20.

The protective padding 62 may be made of fiberglass, polyethylene, rubber, leather, polycarbonate, or any other suitable material for absorbing shock known in the prior art. In a preferred embodiment the protective padding 62 may be used to shock absorbing. In a preferred embodiment one element of the protective padding 62 may be placed on lateral portions of the uppermost end of the jacket 22. It may be suitable for the protective padding 62 to have any configuration on the jacket 22. In a preferred embodiment a user may worn the jacket assembly 20, the shirt assembly 40 or the combination of both to add protection to the user. It also may be suitable to add additional protection when elements of the protection assembly 60 are added to the jacket assembly 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protective jacket armor, comprising:

a jacket assembly, wherein said Jacket assembly includes a jacket, said jacket is made of foam covered by a para-aramid synthetic fiber, said jacket has a fastening down the front of said jacket, wherein said jacket assembly includes containers, said containers are used to store ammunition, said containers have a cylindrical shape, said containers are hollow, said container has an opening to introduce ammunition, said container has a lid, said containers are located on a top-front portion of said jacket, wherein said jacket includes a first layer and a second layer, wherein said first layer is para-aramid synthetic fiber covering said second layer, said second layer is memory foam, wherein said jacket includes compartments, said compartments are built in a rear outer portion and a front inner portion of said jacket, wherein said compartments are accessed through a third zipper;

a shirt assembly, said shirt is removable attached to said jacket, said shirt includes portions built-in foam and covered by para-aramid synthetic fiber, said shirt is a sleeveless shirt, wherein said shirt has includes a first zipper in a left shoulder portion and a second zipper in a right shoulder portion thereof, wherein said first zipper and said second zipper are operated to attach said shirt to a right interior shoulder portion and a left interior shoulder portion of said jacket; and an additional protection assembly, wherein said additional protection assembly includes bulletproof plates and protective padding, said bulletproof plates and said protective padding is capable of being fixed to said jacket, wherein said bulletproof plates are inserted into said compartments to add additional protection to said jacket.

2. The protective jacket armor set forth in claim 1, wherein said fastening is a zipper.

3. The protective jacket armor set forth in claim 1, wherein said jacket assembly includes elbow protection, said elbow protection is built in said jacket.

4. The protective jacket armor set forth in claim 1, wherein said jacket includes pockets, said pockets are built in said jacket.

5. A protective jacket armor, consisting of:

a jacket assembly, wherein said jacket assembly includes a jacket, elbow protection, pockets, containers and compartments, said jacket is made of foam covered by a para-aramid synthetic fiber, said jacket has a fastening down the front of said jacket, said foam of said jacket is a memory foam, said elbow protection is built in said jacket, said containers are used to store ammunition, said containers are used to store ammunition said containers have a cylindrical shape said containers are hollow, said container has an opening to introduce ammunition, said container has a lid, said containers are located on a top-front portion of said jacket, wherein said jacket includes a first layer and a second layer, wherein said first layer is para-aramid synthetic fiber covering said second layer, said second layer is memory foam, wherein said jacket includes compartments, said compartments are built in a rear outer portion and a front inner portion of said jacket, wherein said compartments are accessed through a third zipper;

a shirt assembly, said shirt is removable attached to said jacket, said shirt includes portions built-in foam and covered by para-aramid synthetic fiber, said foam of said shirt is a memory foam, said shirt includes portions built-in foam and covered by para-aramid synthetic fiber, said shirt is a sleeveless shirt, wherein said shirt has includes a first zipper in a left shoulder portion and a second zipper in a right shoulder portion thereof, wherein said first zipper and said second zipper are operated to attach said shirt to a right interior shoulder portion and a left interior shoulder portion of said jacket; and an additional protection assembly, wherein said additional protection assembly includes bulletproof plates and protective padding, said protective padding is removable attached to said jacket, said bulletproof plates are inserted into said compartments of said jacket.

* * * * *